US007651180B2

(12) United States Patent
Deiss et al.

(10) Patent No.: US 7,651,180 B2
(45) Date of Patent: Jan. 26, 2010

(54) DEVICE FOR ADJUSTING THE HEIGHT POSITION OF A DISHWARE BASKET WHICH CAN BE PULLED OUT FROM THE RINSING CONTAINER OF A DISHWASHER

(75) Inventors: Ulrich Deiss, Sontheim (DE); Bernd Schessl, Dillingen (DE); Rainer Schütz, Neresheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 346 days.

(21) Appl. No.: 10/692,160

(22) Filed: Oct. 23, 2003

(65) Prior Publication Data

US 2005/0001524 A1 Jan. 6, 2005

(30) Foreign Application Priority Data

Apr. 26, 2001 (DE) ..... 10120577
Apr. 17, 2002 (WO) ..... PCT/EP02/04264

(51) Int. Cl.
*A47B 88/00* (2006.01)

(52) U.S. Cl. ..... 312/351; 312/311

(58) Field of Classification Search ..... 312/334.4, 312/311, 350, 351; 134/137, 58 D, 200, 134/201; 211/41.8, 41.9, 175, 181.1, 207, 211/208

See application file for complete search history.

(56) References Cited

U.S. PATENT DOCUMENTS 3,472,573 A * 10/1969 Geiger ..... 312/351
3,726,580 A * 4/1973 Guth ..... 312/351
3,726,581 A * 4/1973 Doepke ..... 312/351
3,734,589 A * 5/1973 Morgan ..... 312/351
3,892,453 A * 7/1975 Daily ..... 312/351
5,474,378 A * 12/1995 Smith et al. ..... 312/334.4
5,595,200 A * 1/1997 Favaro ..... 134/201
5,657,878 A * 8/1997 Austin ..... 211/41.8
5,860,716 A * 1/1999 Good et al. ..... 312/311
2005/0039782 A1 * 2/2005 Kim ..... 134/58 D

FOREIGN PATENT DOCUMENTS

| | | | | |
|---|---|---|---|---|
| CH | 690 488 A5 | | 9/2000 | |
| DE | 30 04 110 A1 | | 8/1981 | |
| DE | 4228 954 A1 | | 3/1994 | |
| DE | 44 01 259 A1 | | 7/1995 | |
| DE | 195 12 128 A1 | | 10/1996 | |
| EP | 33483 | * | 8/1981 | ..... 312/334.4 |
| EP | 0848930 | * | 6/1998 | |
| WO | 00/49936 | * | 8/2000 | |
| WO | 02/49495 | * | 6/2002 | |

* cited by examiner

*Primary Examiner*—Hanh V Tran
(74) *Attorney, Agent, or Firm*—James E. Howard; Andre Pallapies

(57) ABSTRACT

A height adjustment device for a dishware basket which can be removed from the rinsing container of a dishwashing machine. The height adjustment device is mounted on the dishware basket and includes at least one basket support plate mounted on the dishware basket. A swivel-mounted handle is mounted on the support plate for moving the dishware basket between an upper and a lower position.

6 Claims, 6 Drawing Sheets

Figure 1:
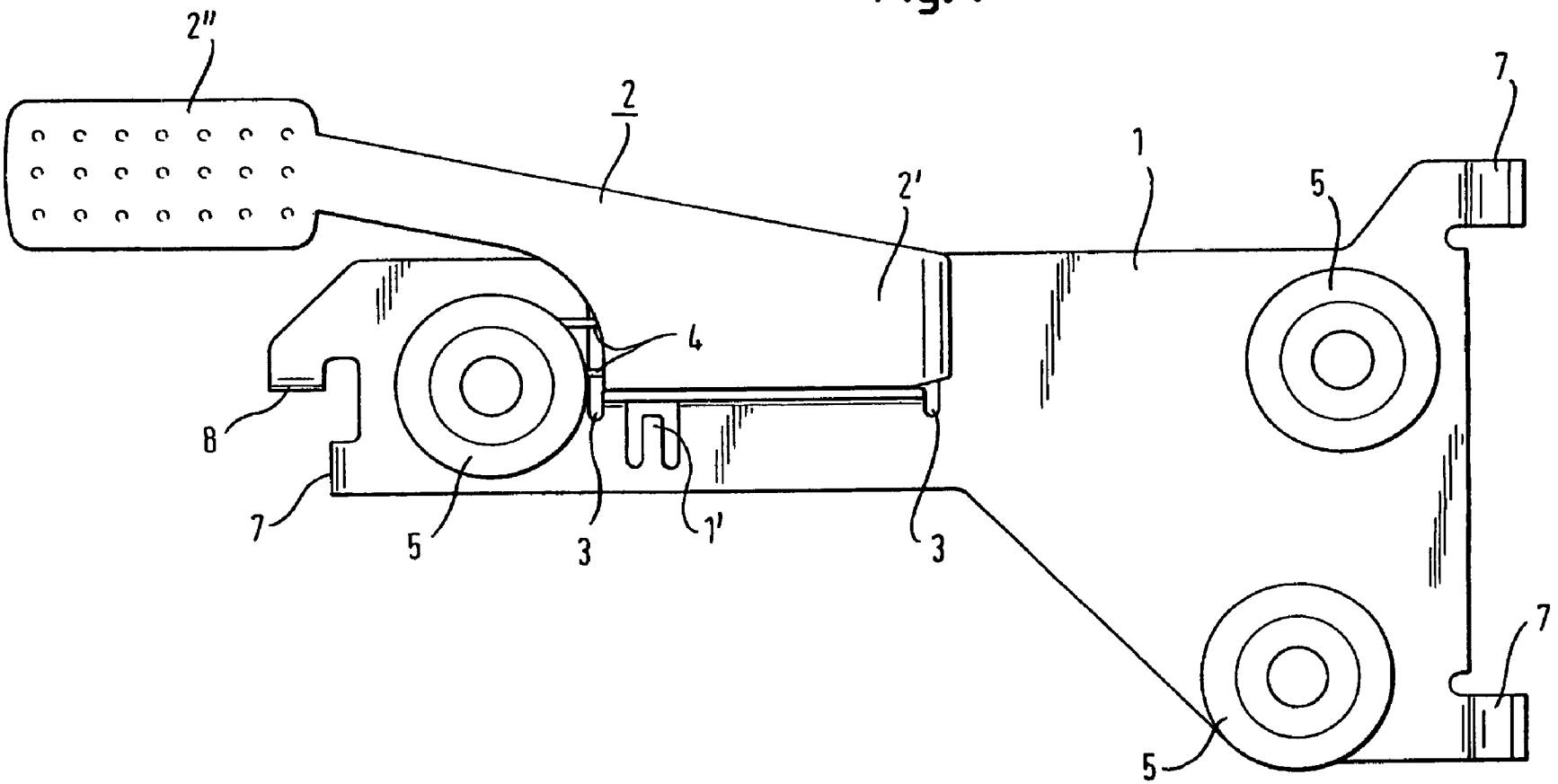

DEVICE FOR ADJUSTING THE HEIGHT POSITION OF A DISHWARE BASKET WHICH CAN BE PULLED OUT FROM THE RINSING CONTAINER OF A DISHWASHER

The invention relates to a device for adjusting the height position of a dishware basket which can be pulled out from the rinsing container of a dishwashing machine according to the preamble of Claim 1.

German disclosure document DE 195 12 128 discloses a device for adjusting the height position of a dishware basket which can be pulled out from the rinsing container of a dishwashing machine, which has a basket support plate mounted on the side wall of the dishware basket formed by horizontally and vertically extending basket struts, fitted with rollers and capable of moving vertically on the basket struts, which can be fixed via an adjustment lever at different height positions on the dishware basket. The adjustment lever linked to a separate lever mounting has at one handle end a handle part and at its other handle end a detent, which lie opposite several latches or support protrusions at various heights on the basket support plate, into which the adjustment lever has to be pivoted by the user with its detent.

German disclosure document DE 44 01 259 also discloses a device for adjusting the height position of a dishware basket which can be pulled out from the rinsing container of a dishwashing machine, in which a basket support plate provided with rollers is arranged on the basket struts and can be adjusted and fixed separately by means of an adjustment lever. The adjustment lever mounted to operate on the exterior of the basket support plate moves a locking element, such that it can be moved vertically between the basket struts fitted with latch positions and can be stopped in each of the latch positions by positive locking.

German disclosure document DE 42 28 954 likewise discloses a device for adjusting the height position of a dishware basket which can be pulled out from the rinsing container of a dishwashing machine, in which a basket support plate provided with rollers is arranged on the basket struts and can be adjusted and fixed separately via an adjustment lever. The adjustment lever is designed as a catch lever accessible from the dishware basket upper side and from the dishware basket exterior hinged in the dishware basket for the basket support plate mounted to move vertically on the dishware basket.

The disadvantages of the known devices are that either the adjustment lever requires a separate lever mounting for adjusting the height position of the basket support plate or it has to shift a separate locking element for this same purpose. This means several, device elements arranged separately from one another, which must cooperate with one another. But above all, all solutions require several catch positions or support projections, into which the adjustment lever is moved by the user corresponding to the various height positions.

The object of the invention is to provide a device of the abovedescribed type, by which adjustment of the height position of an extensible dishware basket is improved.

This task is solved according to the present invention by the characteristics of Claim 1. Further developments of the invention are specified in the sub-claims.

Starting from the basket support plate arranged on the side wall of the dishware basket, provided with rollers and mounted vertically displaceably on the basket struts, and which can be fixed via an adjustment lever at different height positions on the dishware basket, the adjustment lever is attached according to the object of the invention on the basket support plate and is swivel-mounted with its handle end in a recess of the basket support plate. Furthermore, a catch hook oriented to the basket interior, and located in the recess, is arranged on the handle end, by means of which the adjustment lever and the basket support plate automatically engage after the dishware basket moves from a lower height position into an upper height position on a horizontally extending basket strut, and by means of which the adjustment lever and the basket support plate disengage after actuation of a handle part arranged on the other handle end in the direction of the basket interior from the horizontally extending basket strut, and the dishware basket moves automatically from an upper height position into a lower height position.

The object of the invention results advantageously in a self-contained adjustment device, that is, the adjustment lever with catch hook and the basket support plate with corresponding recess form a single unit. The result of this is that all elements required for adjusting the height position of the pull-out dishware basket are arranged directly on the basket support plate. Special elements, such as lever mounting or locking element, spatially separated from the basket support plate can be omitted. The adjustment device according to the object of the present invention enables extremely simple mounting on the dishware basket and prevents crockery from coming into contact with the adjustment device. Latches or support projections located opposite a detent can be dispensed with in the adjustment device according to the object of the present invention, as the adjustment lever and the basket support plate engage automatically on a horizontally extending basket strut via the catch hook when the height position of the dishware basket is altered from below upwards or disengage from above downwards, and the dishware basket moves automatically to the new height position. Another advantage of the invention compared to known adjustment devices is that due to the orientation of the adjustment lever with the catch hook in the basket support plate itself this lever always remains at the same place with respect to the dishwashing machine, that is, it does not alter its position by adjusting the height position of the pull-out dishware basket. This considerably improves the stability of the adjustment device.

According to a favourable development of the invention the adjustment lever is coupled to a spring, by means of which the adjustment lever can be swung back in the opposite direction after the handle part is pivoted in one direction. After the dishware basket is uncoupled from the basket support plate—by actuation of the handle part—the adjustment lever is not swung back by the user but does so automatically.

According to a particularly advantageous development of the invention the catch hook is provided with an undercut, by means of which the actuation force for adjusting the pull-out dishware basket automatically adapts to its load state, which can range from partially to fully loaded.

According to another favourable configuration of the invention the adjustment lever is attached to the basket support plate together with the rollers, resulting in an even more compact and easier-to-mount adjustment device, because it has as many elements as possible.

It has also proven beneficial if the adjustment lever is swivel-mounted near the upper edge of the basket support plate in the recess, since the least actuation force is to be expended by the user to uncouple the dishware basket from the basket support plate, by actuating the handle part.

It has also proven advantageous if the basket support plate is provided at its ends with guide elements, which at least partially engage basket struts of the side wall of the dishware basket. In this way, the adjustment device provided with several elements has a strong grip on the side wall of the dishware basket.

Figure 2:
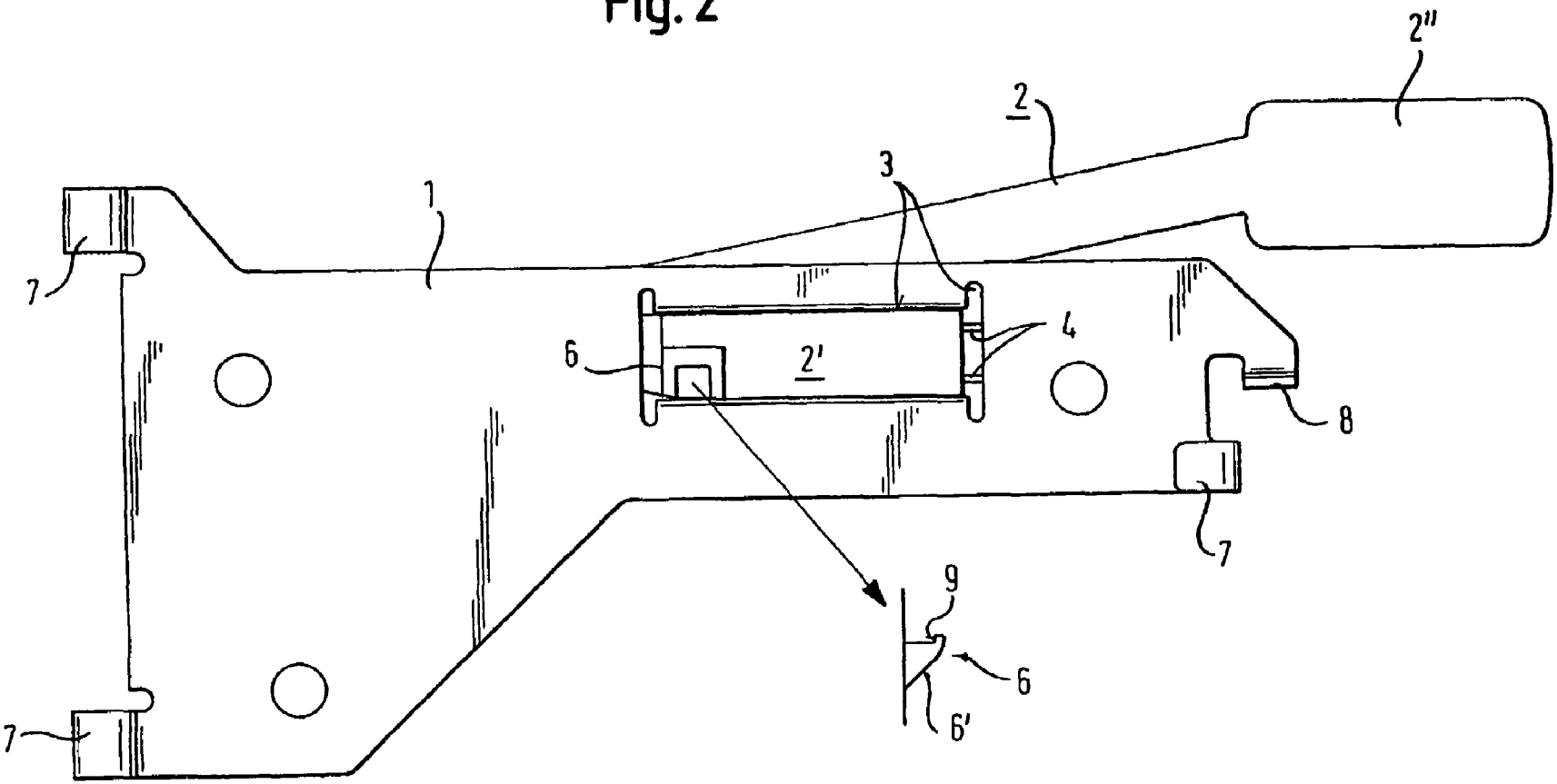
Figure 3:
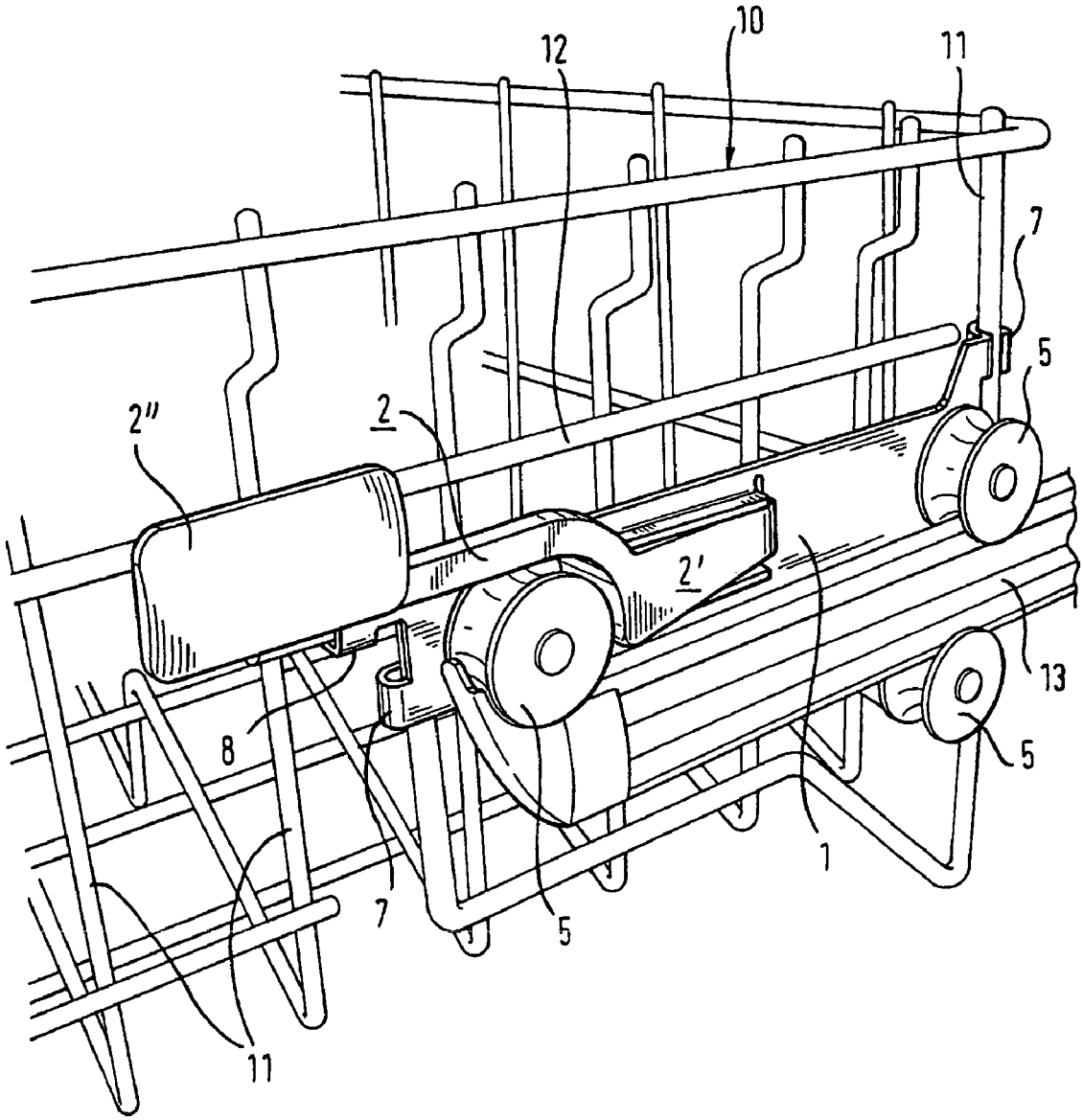
Figure 4:
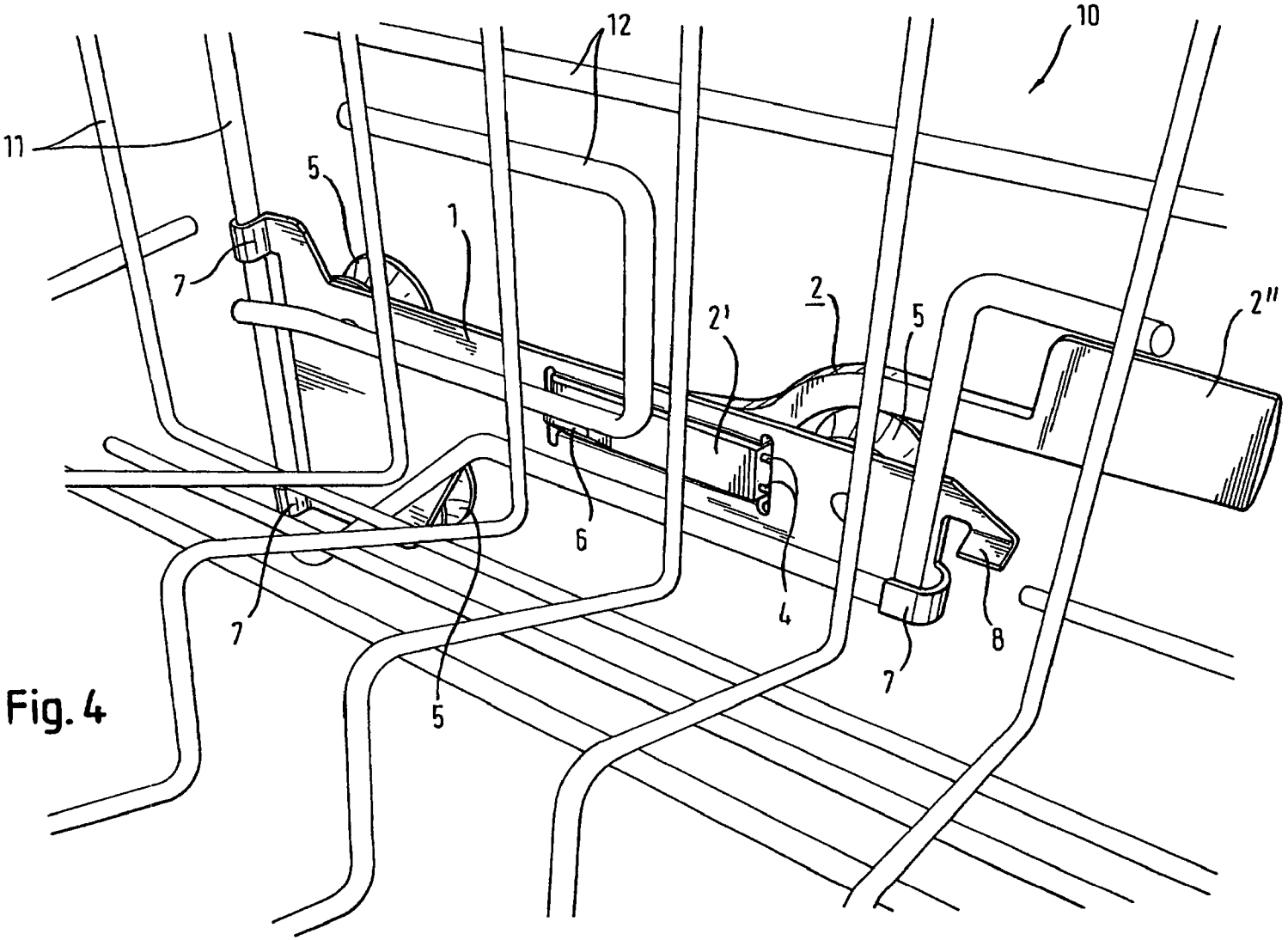
Figure 5:
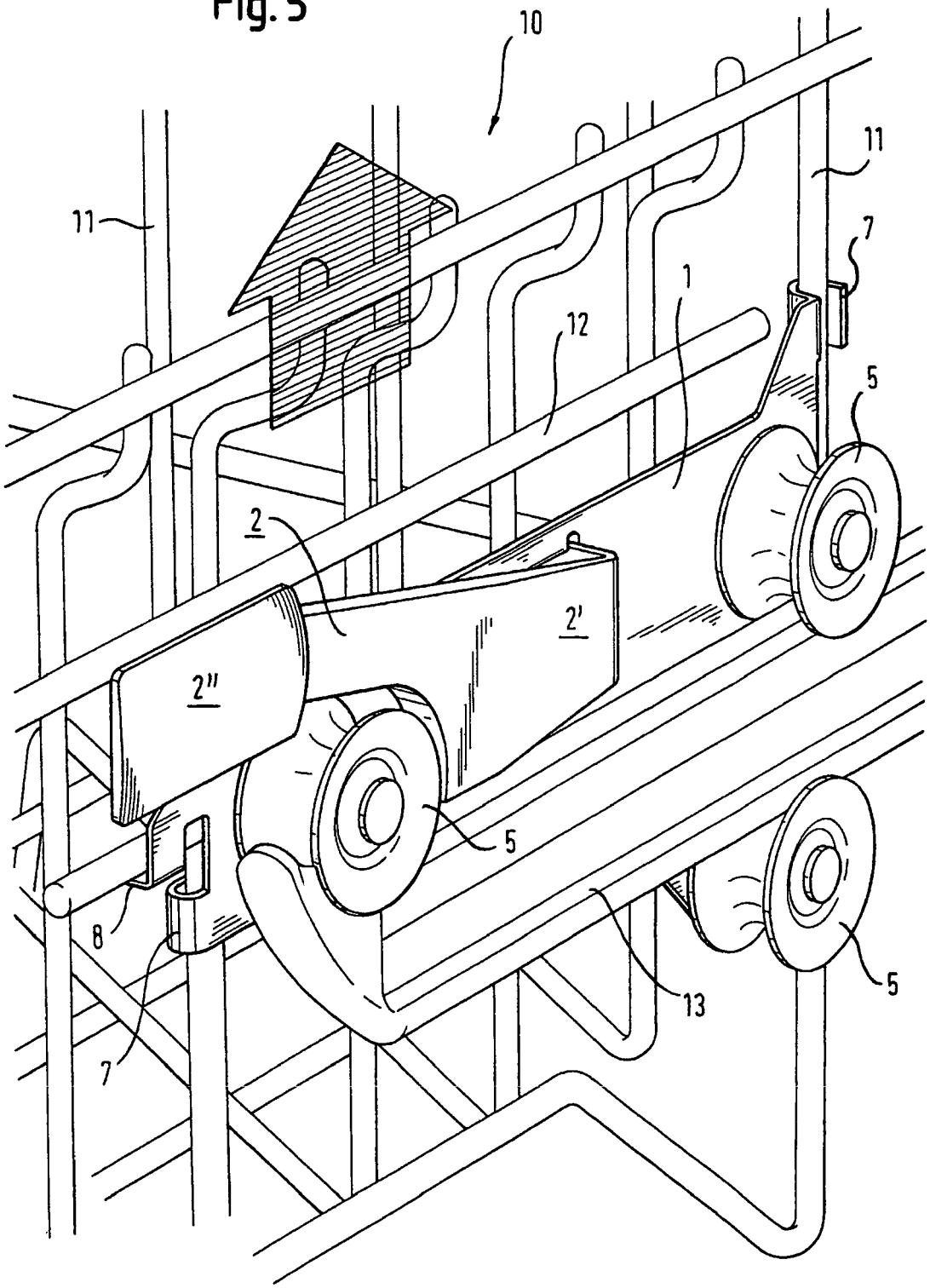
Figure 6:
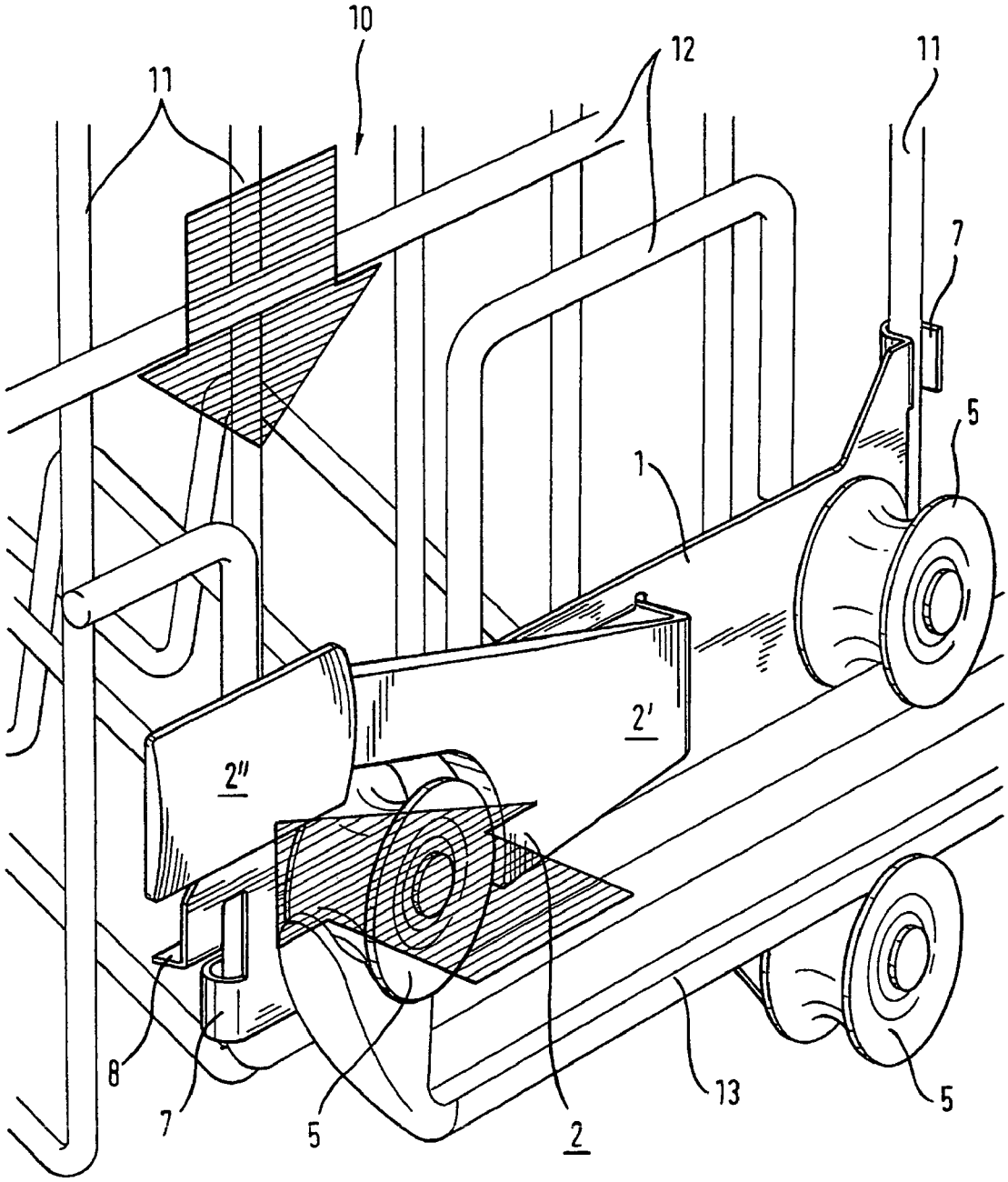

The object of the invention is explained in greater detail with reference to an embodiment illustrated in the diagrams, in which:

FIG. 1 illustrates the adjustment device adjustment device according to the present invention in an external view facing the rinsing container wall of a dishwashing machine, FIG. 2 illustrates the adjustment device according to the present invention in an internal view facing the basket interior of the dishware basket of the dishwashing machine, FIG. 3 illustrates the adjustment device attached to the side wall of the dishware basket in the external view of FIG. 1, FIG. 4 illustrates the adjustment device attached to the side wall of the dishware basket in the internal view of FIG. 2, FIGS. 5 and 6 illustrate the adjustment device as per FIG. 3 on an enlarged scale with an indication of the movement of the dishware basket when the height position is adjusted.

FIG. 1—with an external view facing a rinsing container wall of a dishwashing machine—and FIG. 2—with an inner view facing the basket interior of a dishware basket 10 of the dishwashing machine—show the device according to the present invention for adjusting the height position of the dishware basket 10, which is arranged in a rinsing container of a dishwashing machine for dishes—not illustrated in greater detail here, but described in e.g. DE 195 12 128. At the same time the dishware basket 10 can be pulled out of the rinsing container, to facilitate loading with dishes for the user. Modern adjustment devices enable adjustment of the height position of the dishware basket 10 directly on the dishwashing machine, without the basket having to be taken out of the appliance for this purpose. In addition, adjusting the height position also works in an already loaded dishware basket 10.

The adjustment device has a basket support plate 1, which are arranged on the side wall of the dishware basket 10 formed out of horizontally and vertically extending basket struts, see FIG. 3, and is provided with preferably several rollers 5—a total of three in the example—on the side facing the rinsing container. These rollers 5 move as the dishware basket 10 is pulled out on a basket guide rail—see e.g. reference numeral 13 in FIG. 5 and FIG. 6—, which is usually located near the rinsing container wall. The basket support plate 1 is mounted vertically displaceably on the basket struts and can be fixed via an adjustment lever 2 at different height positions on the dishware basket 10. The adjustment lever 2 is attached according to the present invention on the basket support plate 1 and is swivel-mounted with its handle end 2' in a recess 3 of the basket support plate 1. Arranged on this handle end 2' is a catch hook 6 oriented to the basket interior—that is, on the rear—located in the recess 3, see FIG. 2. Preferably, the catch hook 6 is designed as a triangle and is located on the edge of the recess 3, to cause disengaging of the basket support plate 1 from the dishware basket 10, that is, from the horizontally extending basket strut, in which it is fixed by swivelling the adjustment lever 2 as early as possible and with minimal effort. Due to the triangular shape of the catch hook 6, as evident in the additional side view of the catch hook 6 in FIG. 2, there results a large stop bevel 6' of the catch hook, enabling the dishware basket 10 to be adjusted from the lower height position to the upper height position without actuating the adjustment lever 2. The adjustment device according to the present invention thus represents a compact and self-contained unit, as the elements necessary for adjusting the height position of the pull-out dishware basket 10, in particular the adjustment lever 2 with catch hook 6 swivel-mounted in the basket support plate 1 with corresponding recess 3, are arranged directly on the basket support plate 1. The adjustment device according to the object of the present invention is therefore extremely easily mounted on the dishware basket 10 and prevents dishes coming into contact with the adjustment device.

After the adjustment device is mounted on the dishware basket 10 the adjustment device is fixed on the dishware basket 10 by caulking a safety clip 1', illustrated in FIG. 1 only, punched out of the basket support plate 1 in the direction of the basket interior, by means of which the adjustment device without an additional part is secured against unintentional dislodging from the dishware basket 10 and leads to further simplification in assembly.

Due to the catch hook 6 arranged on the pivoting handle end 2', oriented to the basket interior, located in the recess 3, the adjustment lever 2 and the basket support plate 1 engage automatically on a horizontally extending basket strut, after the dishware basket 10 moves from a lower height position into an upper height position. After actuation of a handle part 2" arranged on the other handle end in the direction of the basket interior the adjustment lever 2 and the basket support plate 1 disengage from the horizontally extending basket strut, and the dishware basket 10 moves automatically from an upper height position into another height position. With the adjustment device according to the present invention latches or support projections located opposite a usual detent can be dispensed with advantageously, which means fewer parts and mutual cooperation. An additional advantage of the invention compared to known adjustment devices is that this lever 2 always remains in the same place, that is, it does not alter its position—with the exception of the intended position in a vertical direction—when the height position of the pull-out dishware basket 10 is adjusted, owing to the position of the adjustment lever 2 with catch hook 6 directly in the basket support plate 1 itself with respect to the dishwashing machine. This considerably improves the stability of the adjustment device.

The adjustment lever 2 is coupled to a spring engaging on the handle end 2'—of which in FIGS. 1 and 2 only the spring legs 4 are visible, while the spring body is incorporated in the pivoting handle end 2'—by means of which the adjustment lever 2 can be swung back in the opposite direction after actuating the handle part 2" in the direction of the basket interior, and thus after the dishware basket 10 is uncoupled from the basket support plate 1—by actuating the handle part 2"—the adjustment lever 2 is not swung back by the user into the start position, but does so automatically.

The catch hook 6 is advantageously provided with an undercut 9, by means of which the actuation force for adjusting the pull-out dishware basket 10 is adapted automatically to its load state—which can range from partially to fully loaded. Preferably, the adjustment lever 2 is attached together with the rollers 5 on the basket support plate 1, resulting in an even more compact and more easily mounted adjustment device—because it has as many elements as possible. It has also proven beneficial if the adjustment lever 2 is swivel-mounted near the upper edge of the basket support plate 1 in the recess 3, because the least effort to uncouple the dishware basket 10 from the basket support plate 1 is needed by the user, by actuating the handle part 2". The basket support plate 1 also has at its ends several guide elements 7, which at least partially enclose the vertically extending basket struts of the side wall of the dishware basket 10. In this way, the adjustment device provided with several elements has a stable grip on the side wall of the dishware basket 10. Also provided at one of the ends of the basket support plate 1 is at least one additional guide element 8 for guiding a horizontally extending basket strut of the side wall belonging to the dishware basket 10.

FIGS. 3 and 4 show the abovedescribed, compact and self-contained adjustment device according to the present invention in the external view of FIG. 1, as well as in the inner view of FIG. 2 after attachment to one of both side walls of the dishware basket 10, respectively formed by horizontally and vertically extending basket struts 11 and 12. For secure and stable fixing to the dishware basket 10 the basket support plate 1 has the guide elements 7 placed on both sides of the basket support plate 1, which engage vertical basket struts 11, of which one basket strut preferably forms the last strut of the side wall. The adjustment lever 2 with handle part 2" is attached according to the present invention to the basket support plate 1 and swivel-mounted with its handle end 2' in the recess of the basket support plate 1. The rollers 5 movably mounted on a basket guide rail are arranged on the sheet metal together with the adjustment lever 2.

FIG. 5 and FIG. 6 show the adjustment device according to the present invention attached to the side wall of the dishware basket 10 on an enlarged scale, with an indication of the movement of the dishware basket 10 when its height position is changed, recognisable by the enlarged arrows in a vertical direction. In FIG. 5 the dishware basket 10 is shown in a lower height position. If the dishware basket 10 is now moved by a user from the lower height position into an upper height position—see the arrow pointing upwards—, for which purpose the adjustment lever 2 does not have to be actuated owing to the abovedescribed long stop bevel 6' of the catch hook 6, then the adjustment lever 2 and the basket support plate 1 engage automatically via the catch hook 6 arranged on the rear side of the pivoting handle end 2' on a horizontally extending basket strut—for example on the strut 12—, and the dishware basket 10 is reset at a new height position. The basket support plate 1 with integrated adjustment lever 2 travels upwards along the vertically extending basket struts 11 stably mounted in the guide elements 7, without the lever needing to alters its position as the height position is being adjusted, which again considerably improves the stability of the adjustment device in the assembled state.

In FIG. 6 the dishware basket 10 is in an upper height position. When the handle part 2" is actuated in the direction of the basket interior—see the arrow pointing horizontally inwards—the adjustment lever 2 and the basket support plate 1 disengage via the catch hook on the handle end 2' oriented to the basket interior, located in the recess on one of the horizontally extending basket struts 12, on which it is fixed by means of the undercut of the catch hook, and the dishware basket 10 moves automatically from an upper height position into a lower height position—see the arrow pointing downwards. The basket support plate 1 with integrated adjustment lever 2 travels downwards along the vertically extending basket struts 11 stably mounted in the guide elements 7, without the lever needing to alters its position as the height position is being adjusted, which again considerably improves the stability of the adjustment device in the assembled state.

The invention claimed is:

1. A device for adjusting the height position of a dishware basket of a dishwashing machine having a rinsing container and a dishware basket having side walls formed from vertically extending basket struts and at least one pair of horizontally extending struts at a vertical spacing from one another, the dishware basket of the dishwashing machine being extendable from, and retractable into, the rinsing container of the dishwashing machine, the device for adjusting the height position of a dishware basket of a dishwashing machine comprising:

a basket support plate adapted to be mounted on a side wall of the dishware basket, said basket support plate including rollers mounted thereto and having a recess;

an adjustment lever pivotally mounted to said basket support plate such that a handle part of the adjustment lever may be pivoted toward and away from said basket support plate, said adjustment lever including a handle end located in said recess;

means for movably mounting said adjustment lever to said basket support plate for movement of said adjustment lever relative to said basket support plate in a first direction from said basket support plate toward the interior of the dishware basket and in a direction opposite to said first direction;

a catch hook on said handle end of said adjustment lever and located in said recess of said basket support plate so as to be oriented to the dishware basket interior when said basket support plate is mounted on a side wall of the dishware basket; and means for biasing said adjustment lever to move in said opposite direction from the interior of the dishware basket toward said basket support plate, said biasing means normally maintaining said handle end of said adjustment lever in a non-actuated disposition in which said catch hook extends into the path of movement of the dishwasher basket such that, when the dishware basket is moved from a lower height position into an upper height position, said catch hook on said handle end of said adjustment lever configured to automatically engage one of the horizontally extending basket struts of the dishwasher basket as the dishware basket completes its movement from the lower height position into the upper height position and actuation movement of said handle part of said adjustment lever in said first direction from said basket support plate toward the interior of the dishware basket against the bias of said biasing means effects disengagement of a guide element of said basket support plate from the dishware basket, whereupon the dishware basket is free to move automatically under the action of gravity from the upper height position into the lower height position.

2. The device according to claim 1, including said adjustment lever arranged on the side of said basket support plate.

3. The device according to claim 1, including said basket support plate provided at its ends with guide elements which at least partially enclose said vertical basket struts of said dishware basket.

4. The device for adjusting the height position of a dishware basket of a dishwashing machine according to claim 1, wherein said biasing means includes a spring coupled to said adjustment lever, said spring biasing said adjustment lever to swivel back in said opposite direction after said handle part of said adjustment lever is actuated in said first direction.

5. The device for adjusting the height position of a dishware basket of a dishwashing machine according to claim 1, wherein said adjustment lever is pivotally mounted to said basket support plate near an upper edge of said basket support plate in said recess.

6. The device for adjusting the height position of a dishware basket of a dishwashing machine according to claim 4, wherein said adjustment lever is pivotally mounted to said basket support plate near an upper edge of said basket support plate in said recess.

* * * * *

UNITED STATES PATENT AND TRADEMARK OFFICE

CERTIFICATE OF CORRECTION

PATENT NO. : 7,651,180 B2
APPLICATION NO. : 10/692160
DATED : January 26, 2010
INVENTOR(S) : Deiss et al.

It is certified that error appears in the above-identified patent and that said Letters Patent is hereby corrected as shown below:

On the title page, the data shown below was listed incorrectly or was omitted and should be as follows:

Related U.S. Application Data

(63) Continuation of Application No. PCT/EP02/04264 filed on Apr. 17, 2002.

(30) Foreign Application Priority Data

Apr. 26, 2001 (DE) .....10120577

~~Apr. 17, 2002 (WO) .....PCT/EP02/04264~~

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,651,180 B2
APPLICATION NO. : 10/692160
DATED : January 26, 2010
INVENTOR(S) : Deiss et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 482 days.

Signed and Sealed this

Twenty-third Day of November, 2010

David J. Kappos

David J. Kappos
*Director of the United States Patent and Trademark Office*